US011629942B2

(12) United States Patent
Gordon et al.

(10) Patent No.: US 11,629,942 B2
(45) Date of Patent: Apr. 18, 2023

(54) ARCHERY SHAFT HAVING A BRAIDED CHARACTERISTIC

(71) Applicant: Blue Curtain LLC, Lone Tree, CO (US)

(72) Inventors: Donald M. Gordon, Lone Tree, CO (US); Edward D. Pilpel, Avon, CT (US)

(73) Assignee: Blue Curtain LLC, Lone Tree, CO (US)

( * ) Notice: Subject to any disclaimer, the term of this patent is extended or adjusted under 35 U.S.C. 154(b) by 0 days.

(21) Appl. No.: 17/320,491

(22) Filed: May 14, 2021

(65) Prior Publication Data

US 2021/0270583 A1 Sep. 2, 2021

Related U.S. Application Data

(60) Continuation of application No. 16/257,324, filed on Jan. 25, 2019, now Pat. No. 11,009,320, which is a division of application No. 15/588,067, filed on May 5, 2017, now Pat. No. 10,228,222.

(60) Provisional application No. 62/332,016, filed on May 5, 2016.

(51) Int. Cl.
*F42B 6/04* (2006.01)

(52) U.S. Cl.
CPC ..... *F42B 6/04* (2013.01)

(58) Field of Classification Search
CPC ..... F42B 6/04
USPC ..... 473/578
See application file for complete search history.

(56) References Cited

U.S. PATENT DOCUMENTS

| | | | | |
|---|---|---|---|---|
| 1,789,575 A | | 1/1931 | Allen | |
| 2,747,876 A | * | 5/1956 | Teller | F42B 6/04 273/DIG. 7 |
| 4,234,190 A | * | 11/1980 | Airhart | F42B 6/04 273/DIG. 7 |
| 4,593,913 A | | 6/1986 | Kochevar | |
| 4,706,965 A | * | 11/1987 | Schaar | F42B 6/04 473/578 |
| 5,273,293 A | * | 12/1993 | Lekavich | F42B 6/04 473/578 |
| 6,017,284 A | * | 1/2000 | Giles | F42B 6/06 473/578 |
| 6,179,736 B1 | * | 1/2001 | Thurber | F42B 6/04 473/578 |
| 6,554,725 B1 | * | 4/2003 | Schaar | F42B 6/04 473/578 |

(Continued)

FOREIGN PATENT DOCUMENTS

FR 2689228 A1 10/1993

OTHER PUBLICATIONS

Graphlex™ XT; on or before Dec. 31, 1989; Gordon Plastics, Inc.; 2 pages.

(Continued)

*Primary Examiner* — Alexander R Niconovich
(74) *Attorney, Agent, or Firm* — Barclay Damon LLP

(57) ABSTRACT

An archery shaft is disclosed herein. The archery shaft, in an embodiment, includes an elongated member having an outer surface. The archery shaft also includes a formation arranged at least partially around the outer surface of the elongated member. The formation has a braided characteristic. Furthermore, the formation has a plurality of reinforcement fibers.

23 Claims, 7 Drawing Sheets

(56) References Cited

U.S. PATENT DOCUMENTS

| | | | | |
|---|---|---|---|---|
| 6,554,726 | B2 * | 4/2003 | Thurber | F42B 6/04 473/578 |
| 6,595,868 | B1 * | 7/2003 | Androlia | F42B 6/04 473/578 |
| 6,821,219 | B2 * | 11/2004 | Thurber | F42B 6/04 473/578 |
| 6,866,599 | B2 * | 3/2005 | Eastman, II | F42B 6/04 473/578 |
| 7,608,002 | B2 * | 10/2009 | Eastman, II | F42B 6/04 473/578 |
| 8,579,739 | B2 * | 11/2013 | Song | F42B 6/04 473/578 |
| 8,915,806 | B2 * | 12/2014 | Asherman | F42B 6/04 473/578 |
| 8,920,694 | B2 * | 12/2014 | Carlston | B29C 63/06 425/134 |
| 8,944,944 | B2 * | 2/2015 | Pedersen | F42B 12/42 473/578 |
| 9,194,671 | B1 * | 11/2015 | Song | F42B 6/04 |
| 9,297,620 | B2 * | 3/2016 | Boretto | F42B 33/001 |
| 9,410,774 | B1 * | 8/2016 | Gallo | F42B 12/362 |
| 9,631,908 | B2 * | 4/2017 | Park | F42B 6/04 |
| 9,644,927 | B2 * | 5/2017 | Connolly | F42B 10/00 |
| 9,829,291 | B2 * | 11/2017 | Boretto | F42B 6/04 |
| 10,001,352 | B1 * | 6/2018 | Song | F42B 6/04 |
| 10,145,643 | B1 * | 12/2018 | Huang | F41B 5/1403 |
| 10,596,770 | B2 * | 3/2020 | Greenwood | B29C 53/043 |
| 2006/0084534 | A1 * | 4/2006 | Flowers | F42B 6/04 473/578 |
| 2006/0281593 | A1 * | 12/2006 | Young | F42B 6/04 473/578 |
| 2009/0291785 | A1 * | 11/2009 | Smith | F42B 6/04 473/578 |
| 2013/0267359 | A1 | 10/2013 | Pedersen | |
| 2015/0141180 | A1 * | 5/2015 | Connolly | F42B 6/04 473/578 |
| 2016/0076862 | A1 * | 3/2016 | Connolly | B29C 70/56 473/578 |
| 2016/0377394 | A1 | 12/2016 | Boretto et al. | |
| 2017/0052007 | A1 * | 2/2017 | Syverson | F42B 6/04 |
| 2017/0086433 | A1 * | 3/2017 | Braun | F42B 6/08 |
| 2017/0314898 | A1 | 11/2017 | Syverson et al. | |

OTHER PUBLICATIONS

Etcheverry et al.; "Glass Fiber Reinforced Polypropylene Mechanical Properties Enhancement by Adhesion Improvement"; Jun. 12, 2012; MDPI; ISSN 1996-1944; 30 pages.

PlastiComp, Inc.; "Benefits of Long Fiber Reinforced Thermoplastic Composites;" on or before May 4, 2016; <http://www.plasticomp.com/long-fiber-benefits/#stiffness>; 14 pages.

Cytec Engineered Materials; PEKK Thermoplastic Polymer Technical Data Sheet; on or before May 4, 2016; 6 pages.

RTP Company; "Long Fiber Compounds"; on or before Dec. 31, 2004; 2 pages.

Professor Joe Green, CSU, CHICO; "Classes of Polymeric Materials"; Dec. 21, 2015; 143 pages; California State University in Chico, California.

Victrex PLC; "Injection Molding"; on or before Mar. 31, 2016; 16 pages.

Canadian Application No. 3,072,701; filed May 5, 2017; Canadian Office Action dated Feb. 9, 2022 (5 pages).

* cited by examiner

ARCHERY SHAFT HAVING A BRAIDED CHARACTERISTIC

CROSS-REFERENCE TO RELATED APPLICATIONS

This application is a continuation of, and claims the benefit and priority of, U.S. patent application Ser. No. 16/257,324 filed on Jan. 25, 2019, which is a divisional of U.S. patent application Ser. No. 15/588,067 filed on May 5, 2017 (now U.S. Pat. No. 10,228,222), which is a non-provisional of, and claims the benefit and priority of, U.S. Provisional Patent Application No. 62/332,016 filed on May 5, 2016. The entire contents of such applications are hereby incorporated by reference.

BACKGROUND

In the field of archery, bows are employed to launch a projectile or arrow at a target. Arrows are subject to bending at: (a) the moment when the bowstring is released by an archer to launch the arrow; and (b) the moment when the arrow strikes a target. Bending of the arrow can result in decreased shooting accuracy. Arrows have been manufactured of various materials in attempts to increase the stiffness of the arrows and thereby decrease bending. For example, arrows have been formed from carbon. U.S. Pat. No. 6,821,219 describes an example of a carbon arrow including fibers oriented to extend both along the longitudinal axis and transverse to the longitudinal axis. However, carbon arrows are subject to various disadvantages, including difficulties in securing fletching and other components to the arrow, difficulties in tuning the arrows, inconsistent weights, relatively high material cost, and complexities in manufacturing, among others.

The foregoing background describes some, but not necessarily all, of the problems, disadvantages and shortcomings related to arrows.

SUMMARY

An archery shaft, in an embodiment, includes an elongated member formed of a matrix material or compound including a thermoplastic material and a plurality of reinforcement fibers embedded in the thermoplastic material. In an embodiment, the reinforcement fibers are oriented to be unidirectional.

In an embodiment, an archery shaft is described. The archery shaft includes an elongated member extending along a longitudinal axis. The elongated member includes a compound material that comprises a thermoplastic material and a plurality of reinforcement fibers. The reinforcement fibers are positioned so as to be parallel to each other.

In another embodiment, an archery shaft is described. The archery shaft includes an elongated core member extending along a longitudinal axis and an elongated member extending along the longitudinal axis and positioned so as to surround, and be concentric with, the core member. The elongated member includes a compound material, and the compound material comprises a thermoplastic material and a plurality of reinforcement fibers. The reinforcement fibers are positioned so as to be parallel to each other.

In yet another embodiment, a process is described for preparing or manufacturing or forming an archery arrow. The process includes shaping a compound material into an elongated member. The compound material includes a thermoplastic material and the shaping step includes applying heat to the thermoplastic material. The process further includes at least partially inserting at least one arrow element in the elongated member while the compound material is pliable and curing the elongated member to form the archery arrow.

Additional features and advantages of the present disclosure are described in, and will be apparent from, the following Brief Description of the Drawings and Detailed Description.

DETAILED DESCRIPTION

The mass of an archery shaft can be expressed in Grains Per Inch ("GPI"), and the mass is a result of the material from which the archery shaft is fabricated and the length and diameter of the archery shaft. The total mass of an archery arrow includes the mass of the archery shaft and the other arrow elements, such as the nock, insert, tip, fletching, and adhesive attached to the archery shaft. The speed of the arrow defines an inverse relationship with the mass of the arrow. As the arrow mass decreases, the arrow speed increases. As the arrow speed increases, the less time a target, such as a deer, will have to react. The total kinetic energy, or "knock-down power," transferred to an arrow is a function of the mass and speed of the arrow. As the kinetic energy transferred to an arrow increases, the greater impact the arrow will have on the target or the greater penetration of the arrow into the target. The forces imparted on the archery shaft during firing and target impact, can urge the arrow to bend or deform. An increase in the stiffness characteristics of the archery shaft causes a decrease in the amount of deformation of the arrow or archery shaft.

Described herein are embodiments of an archery shaft formed of a composite or compound for enhanced shooting accuracy and performance. The archery shaft has an inherent high damage tolerance and improved strength and stiffness properties. Such an archery shaft with increased spine stiffness improves shaft flight accuracy, reduces initial launch distortion of the archery shaft, and reduces energy absorption by the archery shad by minimizing or decreasing bending of the archery shaft during launch. In an embodiment, the archery shaft incorporates the use of lower density thermoplastic matrix systems and high modulus fiber, resulting in higher fiber contents, increasing the overall stiffness of the archery shat.

Figure 1:
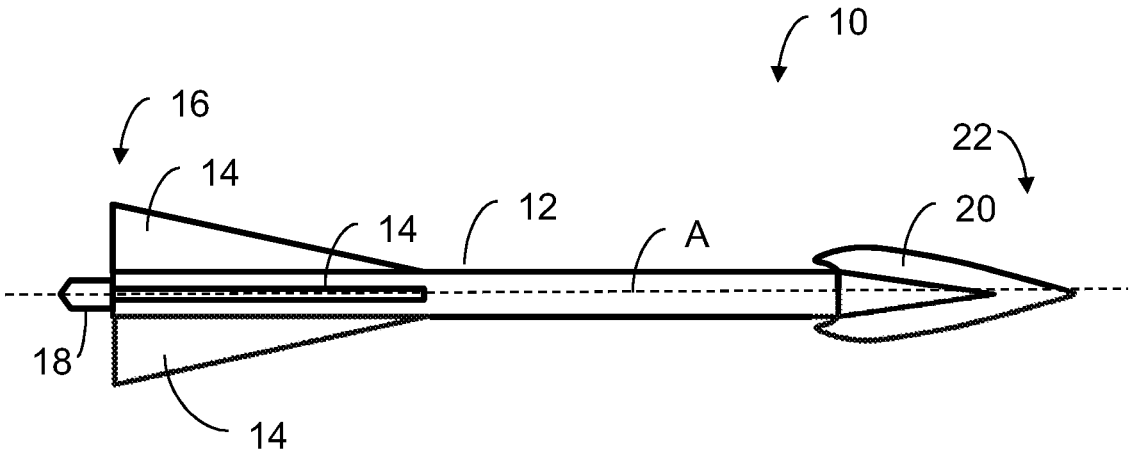
FIG. 1 is a side view of an embodiment of an archery arrow having an archery shaft.

FIG. 1 illustrates an embodiment of an archery arrow 10. The arrow 10 includes an archery shaft 12 extending along a longitudinal axis A. The arrow 10 also includes a plurality of arrow inserts, arrow components or arrow elements. The arrow elements include: (a) a fletching 14 positioned at a first end 16 of the shaft 12; (b) a nock 18 extending from the first end 16; (c) a tubular insert or tubular threaded member (not shown) inserted into the second end 22 opposite the first end 16; and (d) an arrowhead 20 having a ferrule or neck inserted into, and threadably engaged with, such tubular threaded member.

Figure 2A:
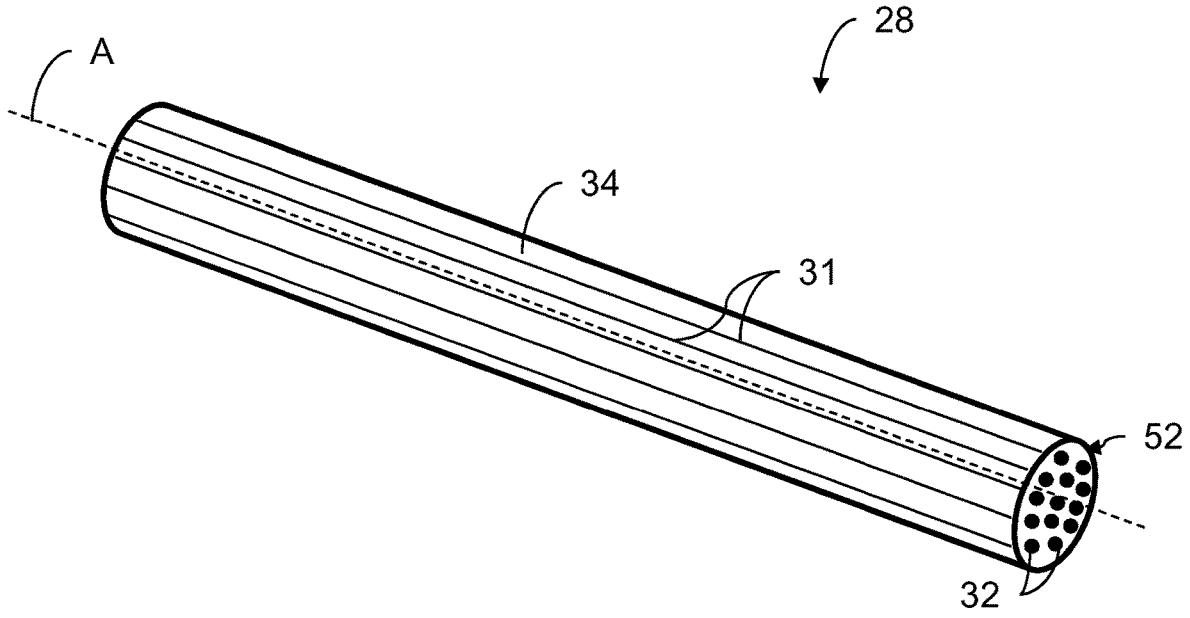
FIG. 2A is an isometric view of an embodiment of an elongated member of an archery shaft.

In an embodiment, the archery shaft 12 (FIG. 1) includes an elongated member 28, as illustrated in FIG. 2A. Depending upon the embodiment, the elongated member 28 can be rod-shaped, tubular-shaped or cylindrical. It should be appreciated that, in non-illustrated embodiments, the elongated member 28 can have a non-cylindrical shape. In such embodiments, the elongated member 28 can have one or more concave or convex regions or varying exterior diameters to reduce drag, reduce air friction and enhance aerodynamic performance.

In the illustrated embodiment, the elongated member 28 is formed from a matrix, composite or compound 31. In this embodiment, the elongated member 28 is a solid rod with uniform density throughout the entire shaft, as illustrated in FIG. 2A; provided, however, that any arrow elements inserted into the elongated member 28 can cause density variation.

In an embodiment, the compound 31 includes a thermoplastic material and a plurality of reinforcement fibers 32, such as fiber polymers and carbon fibers, adhesively bonded with a bonding agent 34, such as for example, a thermoplastic resin. In an embodiment, the compound 31 includes one or more of the following matrix components: polypropylene ("PP"), polyamide ("PA"), polyethylene terephthalate ("PET"), polyphenylene sulphide ("PPS"), polyetherimide ("PEI"), polyetheretherketone ("PEEK"), poly(etherketone-ketone) ("PEKK"), and polyaryletherketone ("PAEK"), among others. In an embodiment, the compound 31 includes one or more fiber reinforced polymers, such as for example, KEVLAR® (a registered trademark of E. I. du Pont de Nemours and Company), basalt and hemp. In an embodiment, the compound 31 includes a fiber hybrid combination of fiber reinforced polymers. In an embodiment, the compound 31 is VICTREX™ PEEK, a material having all of the specifications of such commercially-available product.

In an embodiment, the thermoplastic resin or bonding agent 34 is selected from one of the Olefin, Engineering Thermoplastic and Advanced Thermoplastic categories, such as for example, PP, PE, PA, PET, PPS, PEI, PEEK, PEKK, or blends thereof or other similar blends and alloys. In an embodiment, the compound 31 includes the thermoplastic resin 34 in the range of 15% to 60% by weight, such as 25% to 50% by weight.

In an embodiment, the compound 31 includes reinforcement fibers 32. In an embodiment, the reinforcement fibers 32 are carbon fibers. It should be appreciated that, depending upon the embodiment, the reinforcement fibers 32 can include carbon fibers, glass fibers, natural fibers or a combination thereof, among others. The compound 31 can include the reinforcement fibers 32 in the range of 40% to 85% by weight, such as 50% to 75% by weight of the total weight of the compound 31. In an embodiment, the compound 31 includes reinforcement fibers 32 in the range of about 1000 fibers high to about 50,000 fibers high. In an embodiment, the compound 31 includes reinforcement fibers 32 exhibiting varying moduli of elasticity such as, for example, a combination of low-modulus fibers, medium-modulus fibers, and high-modulus fibers. Typically, a modulus of elasticity is expressed in $10^6$ psi or MM psi. In an embodiment, the varying moduli of elasticity of the reinforcement fibers 32 ranges from about 10 MM psi to about 50 MM psi. In an embodiment, the compound 31 includes reinforcement fibers 32 exhibiting varying tensile strengths such as, for example, a combination of lower tensile strength fibers and higher tensile strength fibers. In an embodiment, the varying tensile strength of the reinforcement fibers 32 ranges from about 120 ksi to about 800 ksi.

In an embodiment, the compound 31 of the elongated member 30 includes a PET, PA and PPS resin matrix with a high modulus 0° carbon fiber orientation (extending along the longitudinal axis A) at a fiber content by weight of 75%+/−10% of the total weight of the compound 31.

The improved high stiffness material properties and high impact resistance properties of the elongated member 28 are obtained by establishing particular fiber orientations within the compound 31 when forming the elongated member 28. In an embodiment, the fibers 32 of compound 31 are orientated at least in the 0° axis, which is parallel to the longitudinal axis A (FIG. 1) of the elongated member 28. In an embodiment, the fibers 32 of the compound 31 are orientated in the 0° axis (parallel to the longitudinal axis A).

Figure 5:
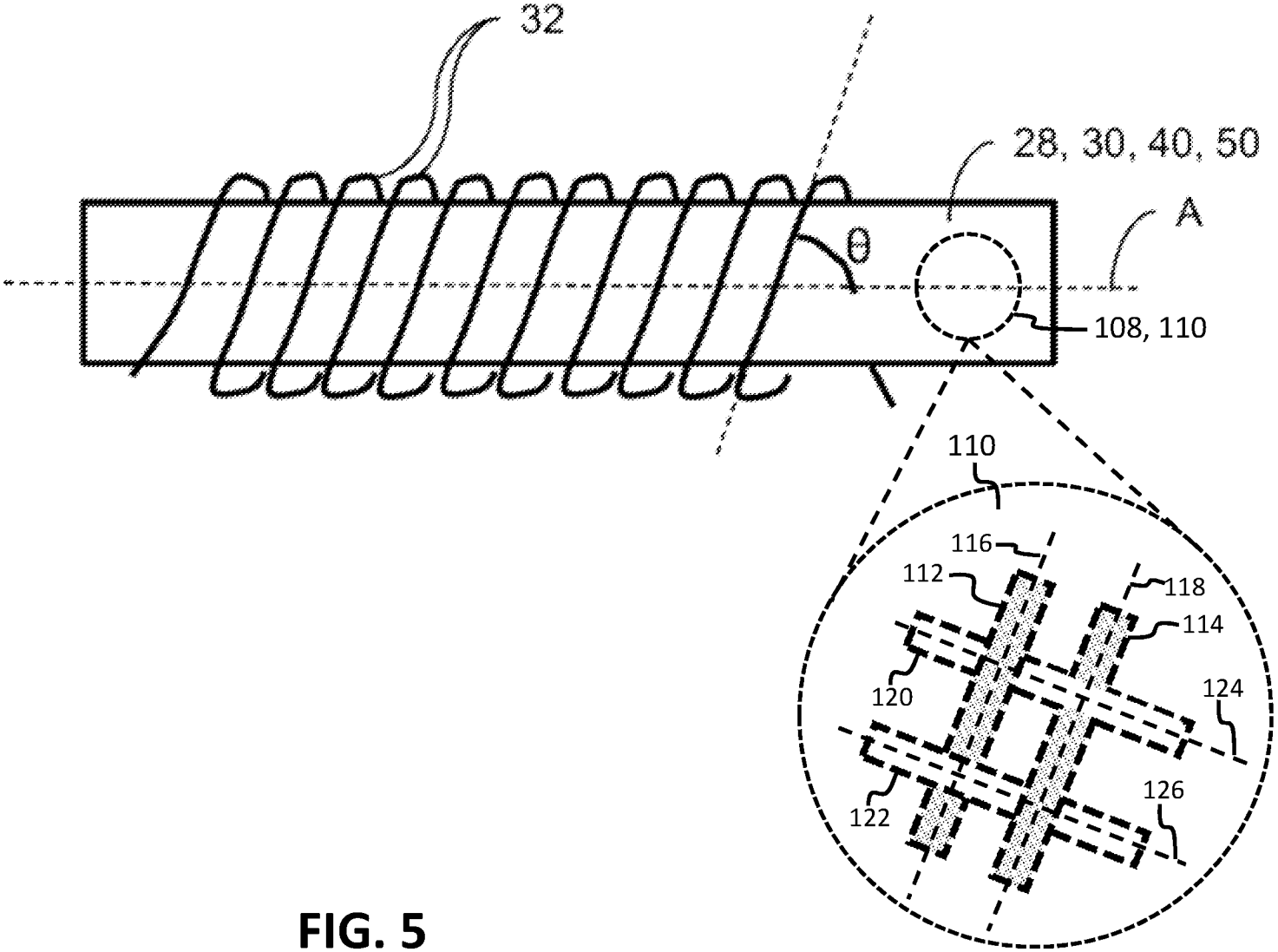
FIG. 5 is a schematic diagram illustrating a helix angle of a plurality of spiral reinforcement fibers positioned on or within an elongated member of an archery shaft.

In an embodiment illustrated in FIG. 5, the fibers 32 are oriented circumferential to the 0° axis at a helix angle θ from the longitudinal axis A, wherein the helix angle θ is within the range of 0° to 75°. In an embodiment, these longitudinal fibers 32 can be spiraled with a helix angle θ from the longitudinal axis of up to 60°. In an embodiment, the fibers 32 of the compound 31 are oriented in a spiral with a helix angle N ranging between 0° to 40° and encircling the 0° axis A. In another embodiment, such helix angle θ ranges from 0° to 75°. In an embodiment, the fibers 32 are unidirectional fibers or extending parallel to each other and are oriented in the 0° axis (parallel to the longitudinal axis A) or otherwise extending substantially parallel to the longitudinal axis A, as illustrated in FIG. 2A.

It should be appreciated that, depending upon the embodiment, the fibers 32 can include: (a) a plurality or cluster of unidirectional fibers that extend parallel to each other; (b) a plurality or cluster of fibers that extend along intersecting axes: (c) a plurality of randomly oriented fibers; (d) a plurality or cluster of fibers that are arc-shaped, curved, or otherwise nonlinear; or (c) any suitable combination of the foregoing fibers.

In an embodiment, the stiffness of one or more sections of the elongated member 28 is selectively adjustable by varying the diametrical cross-sectional shape of the respective section(s) along the longitudinal or 0° axis of the archery shaft 12. For example, the diameter of the elongated member 28 is selectively increased or decreased depending on the desired stiffness of the respective section(s). In an embodiment, the elongated member 28 is constructed using short, medium and long fibers to form a composite structure to generate an omnidirectional or preferred direction archery shaft. Such a composite structure is selectively formed by, for example, compression molding or injection molding. In an embodiment, the length of the fibers 32 ranges from about 0.5 mm to about 125 mm. In an embodiment, the length of the fibers 32 is within a range of 75 mm to 100 mm.

Figure 2B:
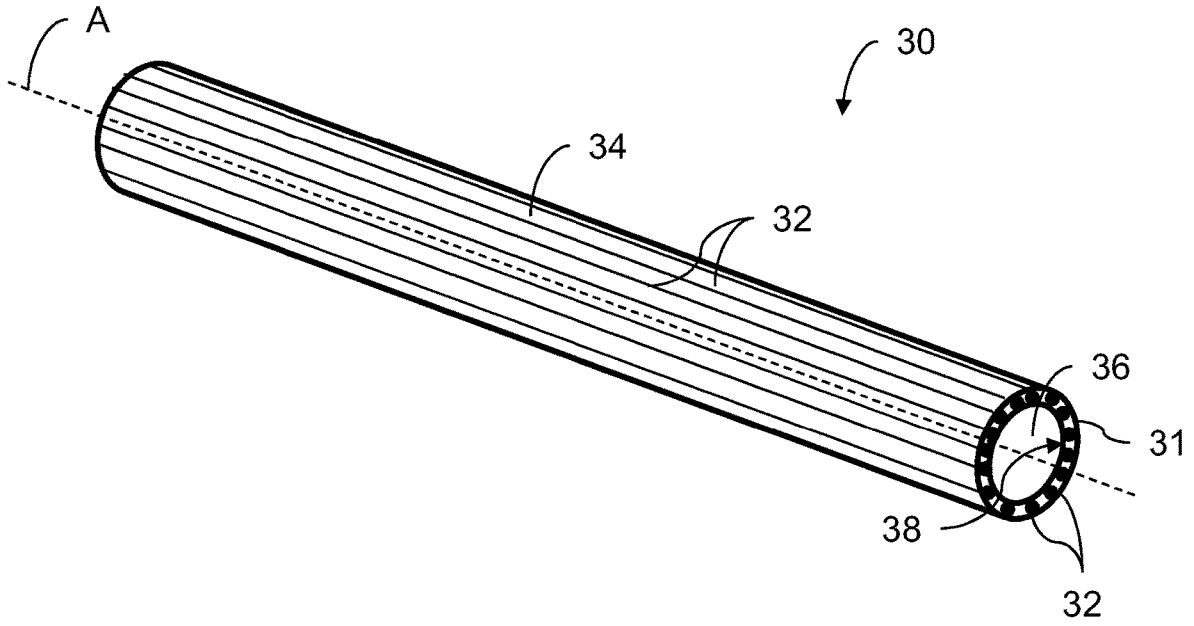
FIG. 2B is an isometric view of another embodiment of an elongated member of an archery shaft, illustrating the core of the elongated member.

In the embodiment illustrated in FIG. 2B, the archery shaft 12 (FIG. 1) includes an elongated member 30. Depending upon the embodiment, the elongated member 30 can be rod-shaped, tubular-shaped or cylindrical. It should be appreciated that, in non-illustrated embodiments, the elongated member 30 can have a non-cylindrical shape. In such embodiments, the elongated member 30 can have one or more concave or convex regions or varying exterior diameters to reduce drag, reduce air friction and enhance aerodynamic performance. The elongated member 30, in this embodiment, is formed from the compound 31 wrapped around an elongated core 36. The core 36 defines an outer diameter or outer periphery 38 upon which the compound 31 is wound. The core 36 functions as a mandrel around which the compound 31 is disposed, thereby forming the elongated member 30. In an embodiment, the bonding agent 34 adhesively binds the compound 31 to the core 36.

In an embodiment, an outer diameter of the elongated member 30 is in the range of about 0.125 inch to about 0.5 inch. In an embodiment, a length of the elongated member 30 has a length in the range of about 6 inches to about 36 inches. In an embodiment, elongated member 30 includes: (a) a plurality of fibers 32 oriented in a first unidirectional fashion extending parallel or substantially parallel to the longitudinal axis A or 0° axis; and (b) a plurality of supplemental fibers 32 oriented in a second unidirectional fashion extending along a plurality of axes, wherein each such axis is orientated at an angle relative to the longitudinal axis A or 0° axis. Depending upon the embodiment, such angle for such supplemental fibers 32 can range from 1° to 89°. Such supplemental fibers 32 can increase hoop strength. In an embodiment, the elongated member 30 includes a plurality of fibers 32 unidirectionally oriented along the longitudinal or 0° axis with the addition of fibers 32 placed around an inside diameter from 1° to 89° to increase hoop strength.

In an embodiment, the core 36 of the elongated member 30 is formed from a metal, thermoplastic resin, thermoset resin, or foam. In an embodiment, the core 36 is formed from a thermoplastic or thermoset resin with glass beads or injected air to form a lightweight core. In an embodiment of the elongated member 30, the core 36 is a foam core formed from a thermoplastic such as, for example, PP, PET, poly (vinyl chloride) ("PVC"), polyethylene ("PE") and polyvinylidene difluoride ("PVDF"). In another embodiment, the core 36 is formed from a thermoset resin such as, for example a phenolic resin or an epoxy. In an embodiment, the core 36 is formed from a metal such as, for example, aluminum. In yet another embodiment, the core 36 is formed from a thermoplastic or thermoset resin in combination with high strength fibers, such fibers being continuous fibers or chopped fibers. In an embodiment, the core 36 is formed from reinforcement fibers impregnated with a thermoset or thermoplastic such as, for example, POLYSTRAND® (a registered trademark of Polystrand, Inc. and commercially available from Polystrand, Inc.). In an embodiment, the core 36 is formed from a thermoplastic epoxy. In another embodiment, the core 36 is formed from recycled materials, such recycled materials optionally including high strength and stiffness fibers such as, for example, Random Oriented POLYSTRAND® (commercially available from Polystrand, Inc.). In an embodiment, the core 36 is extracted from the elongated member 30 upon completion of the forming or molding process such that the elongated member 30 has no core 36. For example, such a core 36 that can be extracted upon completion of the forming process is formed by a hollow bladder or other mandrel-type component.

The improved stiffness properties of the elongated member 28, 30 are selectively adjustable to achieve maximum benefits corresponding to the particular archery objective. In an embodiment, particular core stiffness properties of elongated member 30 are selectively adjustable by varying the configuration of the geometrical size and shape of the elongated member 30. The particular core stiffness properties are further selectively adjustable by specifying a particular fiber type and fiber weight for forming the compound 31 and initiating the formation of the outer circumferential construction of the elongated member 30 orientated in the 0° axis. Thus, the weight and outer circumferential construction of the elongated member 30 are selectively adjustable to performance requirements.

Elongated member 28, 30 further provides enhanced damping properties which are selectively adjustable to achieve maximum benefits corresponding to the particular archery objective. In an embodiment, particular core damping properties of elongated member 30 are selectively adjustable by varying the fiber type, orientation, combination of materials and weight of the components of compound 31. Thus, damping of the natural frequencies individually inherent in such components is attained.

The elongated member 28, 30 further provides an enhanced return rate (i.e., the return of the shaft from a momentary bent shape to a generally straight shape after launch) of the arrow. Such enhanced return rate provides increased speed and greater accuracy of the arrow. The return rate of elongated member 30 is enhanced by the improved core stiffness properties of core 36. Additionally, the return rate of elongated member 30 is selectively adjustable by varying the fiber type, orientation, combination of materials and weight of the components of compound 31.

The weight of elongated member 28, 30 is selectively adjustable to achieve maximum benefits corresponding to the particular archery objective. In an embodiment, the weight of elongated member 28, 30 is adjusted along its length to optimize performance flight performance and accuracy. For example, in an embodiment, the weight of elongated member 28, 30 is forward-weighted to the frontal sectional length of the shall. In an embodiment, the weight of elongated member 28, 30 is adjusted to achieve a desired density of the inner most diametrical area of the shaft along its length. In an embodiment, the weight of elongated member 28, 30 is adjusted by selectively configuring the fiber content along the length of the shaft. In an embodiment, the weight of elongated member 28, 30 is adjusted by selectively configuring the density of fiber placement along the length of the shaft. In an embodiment, the weight of elongated member 28, 30 is adjusted by selectively configuring the density of fiber placement spaced concentric to the diameter of the shaft as further described herein below. In an embodiment, the weight of elongated member 28, 30 is adjusted along the length of the shaft by selectively increasing or decreasing the diameter of the shaft. Moreover, the weight of elongated member 28, 30 is selectively adjustable by a combination of the aforementioned embodiments.

The improved high stiffness material properties and high impact resistance properties of elongated member 30 are achieved by selective formation of the compound 31 and the core 36. In an embodiment, an acrylic monomer is reacted in combination with high strength and stiffness fibers typically with catalysts and heat. In an embodiment, a polyamide monomer is reacted in combination with high strength and stiffness fibers typically with catalysts and heat. In an embodiment, thermosetting urethanes are reacted in combination with high strength and stiffness fibers, typically with catalysts and heat.

Table 1 below compares two embodiments of composite dual layer archery shafts made in accordance with embodiments described herein with: (a) a competitor carbon composite dual layer archery shaft; and (b) an aluminum archery shaft. Table 1 lists measured physical characteristics of the archery shafts, including inner and outer diameters of the outer shaft (O.T) and the inner shaft (I.T), density, plasticity. Young's Modulus, stiffness, and weight/inch of the inner and outer shafts. In addition, Table 1 lists the overall stiffness, weight/inch, and grains/inch of each shaft. As illustrated by Table 1, the elongated member 28, 30 made in accordance with an embodiment described herein, has a significantly higher stiffness EI than the competitor carbon composite dual layer shaft and the aluminum shaft.

TABLE 1

| Material | Composite Dual Tube/shaft | Carbon Composite Dual Tube/shaft | Competitor Carbon Composite Dual Tube/shaft | Aluminum |
|---|---|---|---|---|
| $D_o$ (O.T.) | 0.376 | 0.358 | 0.355 | 0.33 |
| $D_i$ (O.T.) | 0.344 | 0.344 | 0.344 | 0.304 |
| Density (O.T.) | 0.054 | 0.054 | 0.054 | 0.1 |
| $I_x$ (O.T.) | 0.000293578 | 0.000118859 | 9.218E−05 | 0.0001629 |
| E Modulus (O.T.) | 20000000 | 20000000 | 12000000 | 10500000 |
| EI (stiffness, O.T.) | 5871.568896 | 2377.178213 | 1106.1975 | 1710.408 |
| Weight/inch (O.T.) | 0.00097716 | 0.00041682 | 0.0003261 | 0.0012946 |
| $D_o$ (I.T.) | 0.344 | 0.344 | 0.344 | |
| $D_i$ (I.T.) | 0.304 | 0.304 | 0.304 | |
| Density (I.T.) | 0.051 | 0.051 | 0.054 | |
| $I_x$ (I.T.) | 0.000268149 | 0.000268149 | 0.0002681 | |
| E Modulus (I.T.) | 3800000 | 3800000 | 12000000 | |
| EI (stiffness, I.T.) | 1018.966322 | 1018.966322 | 3217.7884 | |
| Weight/inch (I.T) | 0.001038233 | 0.001038233 | 0.0010993 | |
| Total EI | 6890.535218 | 3396.144535 | 4323.9859 | 1710.408 |
| Total Weight/inch | 0.002015393 | 0.001455053 | 0.0014254 | 0.0012946 |
| Grains/inch | 14.10772956 | 10.18535324 | 9.9778342 | 9.0625317 |

Figure 3:
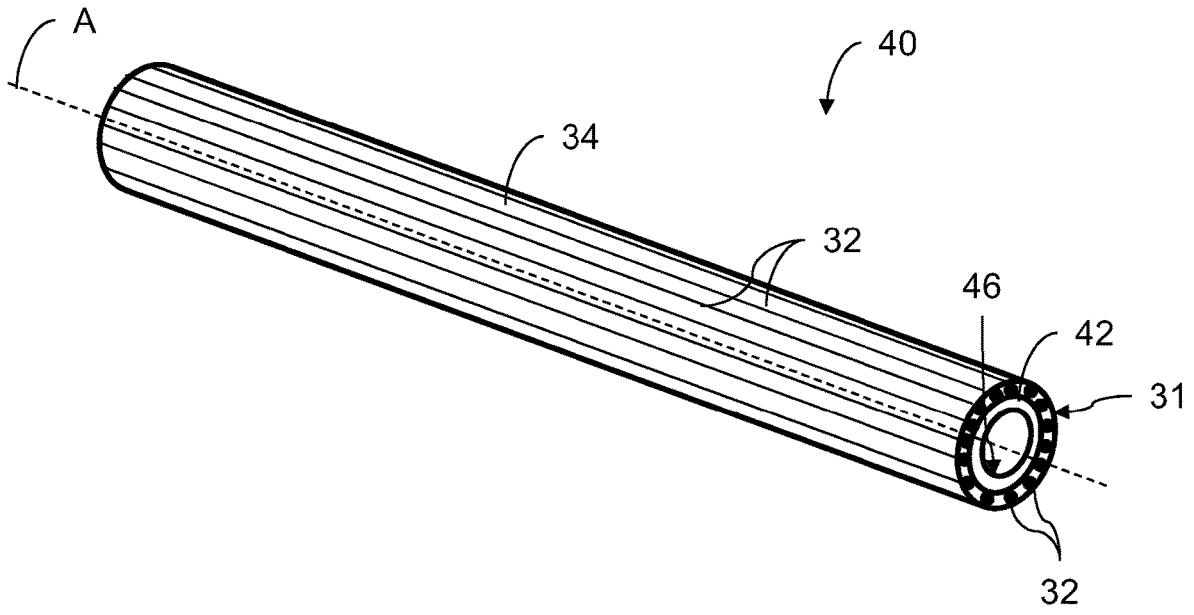
FIG. 3 is an isometric view of yet another embodiment of an elongated member of an archery shaft, illustrating the hollow core of the elongated member.

In the embodiment illustrated in FIG. 3, the archery shaft 12 (FIG. 1) includes an elongated member 40. Depending upon the embodiment, the elongated member 40 can be md-shaped, tubular-shaped or cylindrical. It should be appreciated that, in non-illustrated embodiments, the elongated member 40 can have a non-cylindrical shape. In such embodiments, the elongated member 40 can have one or more concave or convex regions or varying exterior diameters to reduce drag, reduce air friction and enhance aerodynamic performance. In an embodiment, the elongated member 40 has the same structure, composition and elements as elongated member 30 except that elongated member 40 has a hollow core 42. The compound 31 is, formed around the periphery 46 of the hollow core 42. In this embodiment, the hollow core 42 is tubular, defining an elongated air passage extending along the longitudinal axis A.

Figure 4A:
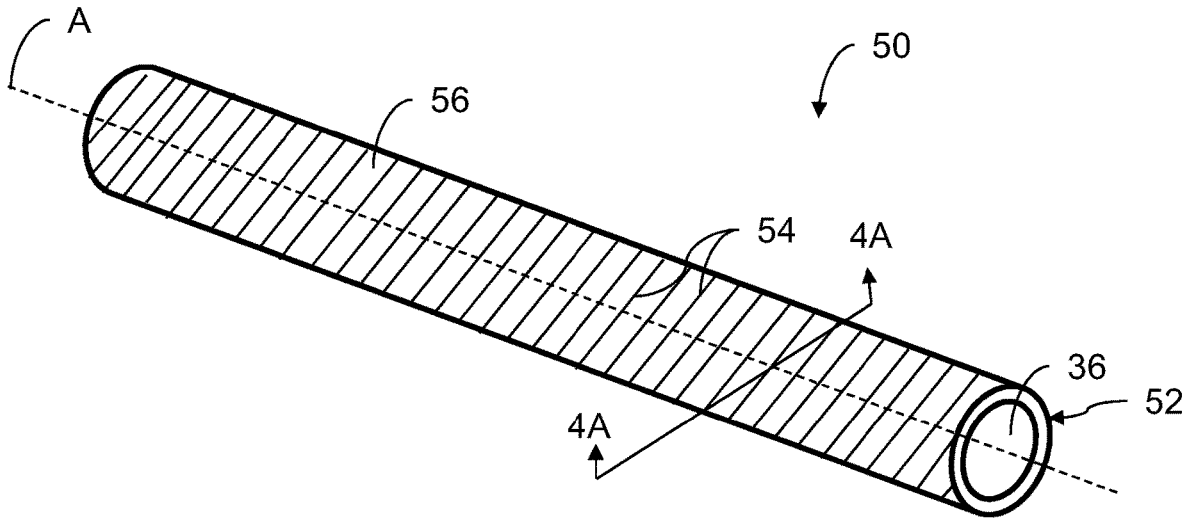
FIG. 4A is an isometric view of another embodiment of an elongated member of an archery shall.
Figure 4B:
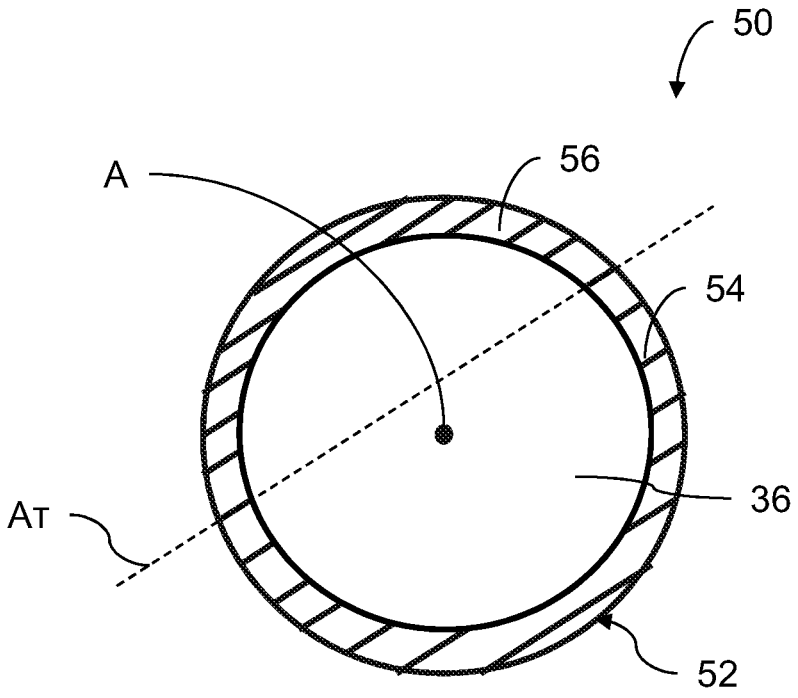
FIG. 4B is a cross-sectional view of the elongated member of FIG. 4A, taken substantially along line 4A-4A.

In the embodiment illustrated in FIGS. 4A-4B, the archery shaft 12 (FIG. 1) includes an elongated member 50. Depending upon the embodiment, the elongated member 50 can be rod-shaped, tubular-shaped or cylindrical. It should be appreciated that, in non-illustrated embodiments, the elongated member 50 can have a non-cylindrical shape. In such embodiments, the elongated member 50 can have one or more concave or convex regions or varying exterior diameters to reduce drag, reduce air friction and enhance aerodynamic performance. In this embodiment, elongated member 50 includes a matrix or compound 52 extending around a core 36. In this embodiment, the compound 52 includes a plurality of reinforcement fibers 54 bonded together by a bonding agent or thermoplastic resin 56. In this embodiment, the reinforcement fibers 54 extend laterally along a transverse or lateral axis AT that intersects with a plane through which the longitudinal axis A extends. In another embodiment (not shown), some or all of the fibers 32 of elongated member 28, 30, 40 extend along a lateral axis AT.

In an embodiment, the processing methods for forming each of the elongated members 28, 30, 40, 50 are selectively configured to achieve the improved high stiffness material properties. High impact resistance properties are achieved by selective formation 108 of the compound 31 and, in certain embodiments, the core 36, 42. Such processing methods for forming the elongated members 28, 30, 40, 50 include, but are not limited to, extrusion, extrusion/pultrusion, compression molding, injection molding, resin transfer molding, resin infusion molding, braiding, and autoclave molding. In an embodiment, selective formation of each of the compounds 31, 52 and each of the cores 36, 42 is achieved by a precision tape lay process as used in aerospace to lay and attach tapes to a core or mandrel. In an embodiment, selective formation of each of the compounds 31, 52 and each of the cores 36, 42 is achieved by a filament winding process. In an embodiment, selective formation of each of the compounds 31, 52 and each of the cores 36, 42 is achieved by shrink wrap molding of a preform using a mandrel of aluminum steel or silicon in combination with an outside-wrapped shrink wrap material, whereby pressure is applied to the outside of the structure to ensure consolidation. Additionally, selective formation 108 of each of the compounds 31, 52 and each of the cores 36, 42 is achieved by a combination of any of the aforementioned processes followed by an over-mold extrusion process, such as for example, by a braiding process followed by extrusion overmolding process, wherein the formation 108, shown in FIG. 5, achieved by such braiding process has: (a) a braided characteristic 110; (b) a first fiber having first fiber segments 112, 114 extending along first axes 116, 118, respectively; and (c) a second fiber having second fiber segments 120, 122 extending along second axes 124, 126, respectively. Being braided, as shown, the first fiber segment 112 extends over the second fiber segment 120 and underneath the second fiber segment 122, and the first fiber segment 114 extends underneath the second fiber segment 120 and over the second fiber segment 122. In an embodiment, a fiber preform is placed into a mold and a thermoplastic monomer, such as for example an acrylic or PA, is injected into the evacuated mold and is polymerized in the mold. In an embodiment, each of the elongated members 28, 30, 40, 50 is formed by one of a captolactic, alactic, and arkema process or by a combination thereof.

In an embodiment, the archery arrow 10 (FIG. 1) is formed such that one or more of the arrow elements 14, 18, 20 or the tubular insert (not shown) is integral to the archery shaft 12, whether composed of elongated member 28, 30, 40 or 50. In this embodiment, the compound 31, 52, including a thermoplastic material, is formed using any suitable method, such as a molding process. Following the molding process and prior to curing or solidification of the thermoplastic material, at least one arrow element, such as fletching 14 or nock 18, is directly integrated (at least partially) into the elongated member 28, 30, 40, 50. For example, the nock 18 or any or all of the arrow elements can be pressed or inserted into a soft surface of the elongated member 28, 30, 40, 50 at a time when the surface is heated to a designated temperature. Depending upon the embodiment, the temperature can be a temperature point above room temperature or a temperature point at or near the melting point of such thermoplastic material. Next, the elongated member 28, 30, 40, 50 is allowed to solidify or cure around the one or more inserted arrow elements. At this point, such arrow elements are fused with the elongated member 28, 30, 40, 50, which increases the coupling integrity of the arrow elements to the elongated member 28, 30, 40, 50.

In an embodiment, the compound 31, 52 described herein defines a low tolerance dimensional envelope having a low coefficient-of-thermal-expansion ("CTE") providing high impact resistance properties. Such a combination of high stiffness material properties and high impact resistance properties of the compound 31, 52 provides overall increased damage tolerance and improvements to the overall performance and durability of the elongated member 28, 30, 40, 50 in comparison to known conventional archery shafts. The elongated member 28, 30, 40, 50 exhibits several primary attributes, thereby achieving the improved high stiffness material properties, and high impact resistance properties and increased damage tolerance.

In an embodiment, the archery shaft 12 (FIG. 1) is constructed and composed of elongated member 28, 30, 40 or 50, any combination thereof, or any suitable formulation of compound 31 or 52.

The publicly available specifications of the following commercially-available products are hereby incorporated by reference into this written description: KEVLAR®, VICTREX™ PEEK, POLYSTRAND®, and Random Oriented POLYSTRAND®.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery shaft comprising:

an elongated member comprising:

(a) a first compound material;

(b) a core surface; and (c) an exterior surface coupled to the core surface, wherein the exterior surface is uncovered by any other surface of the elongated member;

wherein the exterior surface comprises a formation that is positioned around the core surface of the elongated member, wherein the formation comprises a braided characteristic achieved by a braiding process, wherein the formation comprises a second compound material, wherein the second compound material comprises first and second clusters of reinforcement fibers, wherein a plurality of the reinforcement fibers within the first cluster are oriented to be parallel to each other, wherein a plurality of the reinforcement fibers within the second cluster are oriented to be parallel to each other, wherein each of the reinforcement fibers in the first cluster extends in a direction along a first fiber axis, wherein each of the reinforcement fibers in the second cluster extends in a direction along a second fiber axis, wherein each of the first fiber axes intersects with one of the second fiber axes.

2. The archery shaft of claim 1, wherein:

the elongated member comprises a core;

the core comprises the core surface; and the core comprises one of a solid configuration and a hollow configuration.

3. The archery shaft of claim 2, wherein the second compound material is wrapped around the core.

4. The archery shaft of claim 2, wherein the reinforcement fibers of at least one of the first and second clusters comprise a spiral arrangement around the core.

5. The archery shaft of claim 1, wherein:

the first compound material comprises a plurality of first reinforcement fibers; and a plurality of the first reinforcement fibers are oriented be parallel to each other.

6. The archery shaft of claim 1, wherein the second compound material comprises a thermoplastic material that excludes epoxy.

7. The archery shaft of claim 1, wherein the elongated member is configured to be coupled to an arrow element.

8. The archery shaft of claim 1, comprising at least one arrow element supported by the elongated member, wherein the at least one arrow element is at least partially in contact with the formation of the exterior surface.

9. An archery shaft comprising:

an elongated member comprising an intermediary surface and an exterior surface that at least partially covers the intermediary surface, wherein the exterior surface is exposed to air when the archery shaft is launched in the air toward a target;

wherein the exterior surface comprises a formation that is arranged at least partially around the intermediary surface of the elongated member, wherein the formation comprises a braided characteristic, wherein the formation comprises a plurality of reinforcement fibers.

10. The archery shaft of claim 9, wherein:

the elongated member comprises a core;

the core comprises the intermediary surface; and the core comprises one of a solid configuration and a hollow configuration.

11. The archery shaft of claim 10, wherein the formation comprises a compound material that is wrapped around the core.

12. The archery shaft of claim 10, wherein a plurality of the reinforcement fibers spiral around the core.

13. The archery shaft of claim 9, wherein the braided characteristic is a result of a braiding process.

14. The archery shaft of claim 9, wherein:

the formation comprises a compound material;

the compound material comprises first and second clusters of the reinforcement fibers; and a plurality of the reinforcement fibers within the first cluster are oriented to be parallel to each other.

15. The archery shaft of claim 14, wherein:

a plurality of the reinforcement fibers within the second cluster are oriented to be parallel to each other;

each of the reinforcement fibers in the first cluster extends in a direction along a first fiber axis;

each of the reinforcement fibers in the second cluster extends in a direction along a second fiber axis; and each of the first fiber axes intersects with one of the second fiber axes.

16. The archery shaft of claim 9, wherein the formation comprises a thermoplastic material that excludes epoxy.

17. The archery shaft of claim 9, wherein the elongated member is configured to be coupled to an arrow element.

18. An archery arrow comprising the archery shaft of claim 9.

19. The archery shaft of claim 9, comprising at least one arrow element supported by the elongated member, wherein the at least one arrow element is at least partially in contact with the formation of the exterior surface.

20. An archery shaft comprising:

an elongated member comprising:

an intermediary surface that comprises a first compound material; and an exterior surface that is exposed to air when the archery shaft is launched in the air toward a target, wherein the exterior surface comprises a formation of a second compound material that is arranged at least partially around the intermediary surface of the elongated member, wherein the formation comprises a braided configuration, wherein the formation comprises a plurality of fibers.

21. The archery shaft of claim 20, wherein:

the elongated member comprises a core;

the core comprises the intermediary surface;

the core comprises one of a solid configuration and a hollow configuration;

a plurality of the fibers are spirally-arranged around the core; and the spirally-arranged fibers are oriented to be parallel to each other.

22. The archery shaft of claim 20, wherein:

the braided configuration is a result of a braiding process;

the second compound material comprises first and second clusters of the fibers;

a plurality of the fibers within the first cluster are oriented to be parallel to each other;

a plurality of the fibers within the second cluster are oriented to be parallel to each other;

each of the fibers in the first cluster extends in a direction along a first fiber axis;

each of the fibers in the second cluster extends in a direction along a second fiber axis; and each of the first fiber axes intersects with one of the second fiber axes.

23. The archery shaft of claim 20, comprising at least one arrow element supported by the elongated member, wherein the at least one arrow element is at least partially in contact with the formation.

* * * * *